US010913284B2

(12) United States Patent
Tanoue et al.

(10) Patent No.: US 10,913,284 B2
(45) Date of Patent: Feb. 9, 2021

(54) INKJET PRINTING APPARATUS, AND AN INK FEEDING METHOD THEREFOR

(71) Applicant: SCREEN HOLDINGS CO., LTD., Kyoto (JP)

(72) Inventors: Kazuyuki Tanoue, Kyoto (JP); Hiroaki Kishida, Kyoto (JP); Mitsuru Tanemoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 7 days.

(21) Appl. No.: 16/402,037

(22) Filed: May 2, 2019

(65) Prior Publication Data

US 2019/0344578 A1 Nov. 14, 2019

(30) Foreign Application Priority Data

May 10, 2018 (JP) ..... 2018-091595

(51) Int. Cl.
*B41J 2/175* (2006.01)

(52) U.S. Cl.
CPC ..... *B41J 2/17566* (2013.01)

(58) Field of Classification Search
CPC B41J 2/17566; B41J 2/17596; B41J 2/17506; B41J 2/175
USPC ..... 347/7, 84, 85
See application file for complete search history.

(56) References Cited

U.S. PATENT DOCUMENTS 9,340,028 B2 * 5/2016 Hassaka ..... B41J 2/17513
10,195,867 B2 * 2/2019 Bayona ..... B41J 2/17596
10,434,783 B2 * 10/2019 Koganehira ..... B41J 2/17556

FOREIGN PATENT DOCUMENTS

JP 2016-187884 A 11/2016

* cited by examiner

*Primary Examiner* — An H Do
(74) *Attorney, Agent, or Firm* — McDermott Will & Emery LLP

(57) ABSTRACT

An inkjet printing apparatus for forming images with ink droplets includes the following elements: an inkjet head, a plurality of holders for removably holding a plurality of ink tanks storing inks interchangeable with each other, branch pipes each having one end thereof connected to one of the ink tanks, a mixer provided at the other ends of the branch pipes, a pump for feeding the inks to the mixer, a feed pipe connecting the mixer and the inkjet head, and a controller for controlling ink feeding. The controller makes different a feed rate of the ink from each of the ink tanks.

18 Claims, 4 Drawing Sheets

INKJET PRINTING APPARATUS, AND AN INK FEEDING METHOD THEREFOR

BACKGROUND OF THE INVENTION

(1) Field of the Invention

This invention relates to an inkjet printing apparatus for forming images by dispensing ink droplets to a printing medium, and an ink feeding method therefor. More particularly, the invention relates to a technique for feeding ink to an inkjet head.

(2) Description of the Related Art

Conventionally, this type of apparatus includes two branch pipes connected to two ink tanks, a main pipe connected at one end thereof to an inkjet head and at the other end to the branch pipes, a changeover switch mounted on the main pipe for selectively connecting only one of the branch pipes to the main pipe, and a pump for feeding ink from the ink tanks to the inkjet head (see Japanese Unexamined Patent Publication No. 2016-187884, for example).

The two ink tanks noted above store interchangeable inks. The interchangeable inks are, for example, products by the same manufacturer and having the same color.

With the inkjet printing apparatus constructed in this way, the changeover switch is operated to connect one of the two ink tanks to the main pipe. In this state, the ink in the one ink tank is fed to the inkjet head to carry out printing. When the ink in the one ink tank is exhausted, the changeover switch is operated to connect the other ink tank to the main pipe. So, the ink in the other ink tank is fed to the inkjet head to continue the printing.

However, the conventional example with such construction has the following problem.

That is, when the inks in the two ink tanks are from different manufacturing lots, the operation of the changeover switch to switch from one ink tank to the other causes a problem of a conspicuous difference in ink density on printed products, thus lowering print quality.

The inks in the ink tanks are, at manufacturing times, subjected to a strict control on a lot-by-lot basis of their physical properties such as density and viscosity. However, although the inks of all the lots fall within the control range of physical properties, differences will occur between the lots within the control range. This results in a conspicuous density difference on prints which occurs with switching of the ink manufacturing lots.

SUMMARY OF THE INVENTION

This invention has been made having regard to the state of the art noted above, and its object is to provide an inkjet printing apparatus and an ink feeding method therefor, which can inhibit a deterioration of print quality even with change of ink manufacturing lots.

To fulfill the above object, this invention provides the following construction.

This invention provides an inkjet printing apparatus for forming images with ink droplets, comprising an inkjet head for dispensing ink fed thereto to form images on a printing medium; a plurality of holders for removably holding a plurality of ink tanks storing inks interchangeable with each other; branch pipes each having one end thereof connected to the ink tank held by one of the holders; a mixer provided at the other ends of the branch pipes; a pump for feeding the ink from each holder to the mixer; a feed pipe connecting the mixer and the inkjet head; and a controller for controlling ink feeding to the mixer; wherein the controller feeds the inks from all the ink tanks held by the holders to the mixer, and makes different a feed rate of the ink from each of the ink tanks held by the holders.

According to this invention, the controller feeds the inks from all the ink tanks to the mixer, and makes different a feed rate of the ink from each of the ink tanks held by the holders. Consequently, since the inks are mixed in the mixer, even if the inks are manufactured in different lots, differences in the physical properties between the lots are reduced. As a result, even if the manufactured lot of the ink in the ink tank changes when the ink tank is changed, an ink density difference in prints is inconspicuous, which can inhibit deterioration of print quality. Moreover, since all the ink tanks do not become empty at the same time, no lowering occurs in the operating rate of the apparatus.

In this invention, it is preferred that the holders include two holders which are a first holder and a second holder; and the controller feeds the ink from the ink tank held by the first holder to the mixer at a first feed rate, and feeds the ink from the ink tank held by the second holder to the mixer at a second feed rate different from the first feed rate.

When the holders include two holders which are a first holder and a second holder, the controller makes different a first feed rate which is the feed rate of the ink from the ink tank held by the first holder and a second feed rate which is the feed rate of the ink from the ink tank held by the second holder. This can inhibit deterioration of print quality while preventing the two ink tanks from becoming empty at the same time.

In this invention, it is preferred that the controller maintains the first feed rate and the second feed rate until one of the ink tanks held by the first holder and the second holder becomes empty.

Since the controller only maintains the different feed rates of the first feed rate and second feed rate, the feed rate control of ink can be performed easily.

In this invention, it is preferred that the controller compares remaining amounts in the ink tanks held by the first holder and the second holder, sets the first feed rate>the second feed rate when the remaining amount in the ink tank held by the first holder is smaller, and sets the first feed rate<the second feed rate when the remaining amount in the ink tank held by the second holder is smaller.

Using with priority the ink tank having the less ink remaining amount can prevent overlapping of timing of the two ink tanks held by the first holder and second holder becoming empty.

In this invention, it is preferred that the holders include two holders which are a first holder and a second holder; and the controller feeds the ink from the ink tank held by the first holder to the mixer at a first feed rate, feeds the ink from the ink tank held by the second holder to the mixer at a second feed rate different from the first feed rate, brings the first feed rate gradually close to the second feed rate, and brings the second feed rate gradually close to the first feed rate.

Since the ink mixing ratio in the mixer varies gradually, there occurs no shift of balance toward one of the ink from the ink tank held by the first holder and the ink from the ink tank held by the second holder. Consequently, even when ink manufacturing lots are different, the difference in physical properties between the lots can be further reduced.

In this invention, it is preferred that each branch pipe has a switch valve mounted thereon for permitting or blocking flow of the ink; the pump is mounted on the feed pipe; and the controller controls opening and closing of each switch valve to vary the feed rate.

The ink feed rate can be controlled only by changing the number of times of opening and closing or amount of time of opening and closing of each switch valve. Thus, the control can be carried out more easily than where adjustment is carried out of opening degrees of flow regulating valves or of liquid feed rates of pumps.

In another aspect of this invention, an ink feeding method is provided for an inkjet printing apparatus which forms images with ink droplets. The apparatus has an inkjet head for dispensing ink fed thereto to form the images on a printing medium; a plurality of holders for removably holding a plurality of ink tanks storing inks interchangeable with each other; branch pipes each having one end thereof connected to the ink tank held by one of the holders; a mixer provided at the other ends of the branch pipes; and a pump for feeding the ink from each holder to the mixer. The method comprises a feeding step for feeding the inks from all the ink tanks held by the holders to the mixer, making different a feed rate of the ink from each of the ink tanks held by the holders.

According to this invention, the feeding step feeds the inks from all the ink tanks to the mixer, and makes different a feed rate of the ink from each of the ink tanks held by the holders. Consequently, since the inks are mixed in the mixer, even if the inks are manufactured in different lots, differences in the physical properties between the lots are reduced. As a result, even if the manufactured lot of the ink in the ink tank changes when the ink tank is changed, an ink density difference in prints is inconspicuous, which can inhibit deterioration of print quality. Moreover, since all the ink tanks do not become empty at the same time, no lowering occurs in the operating rate of the apparatus.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

A preferred embodiment of this invention will be described in detail hereinafter with reference to the drawings.

Figure 1:
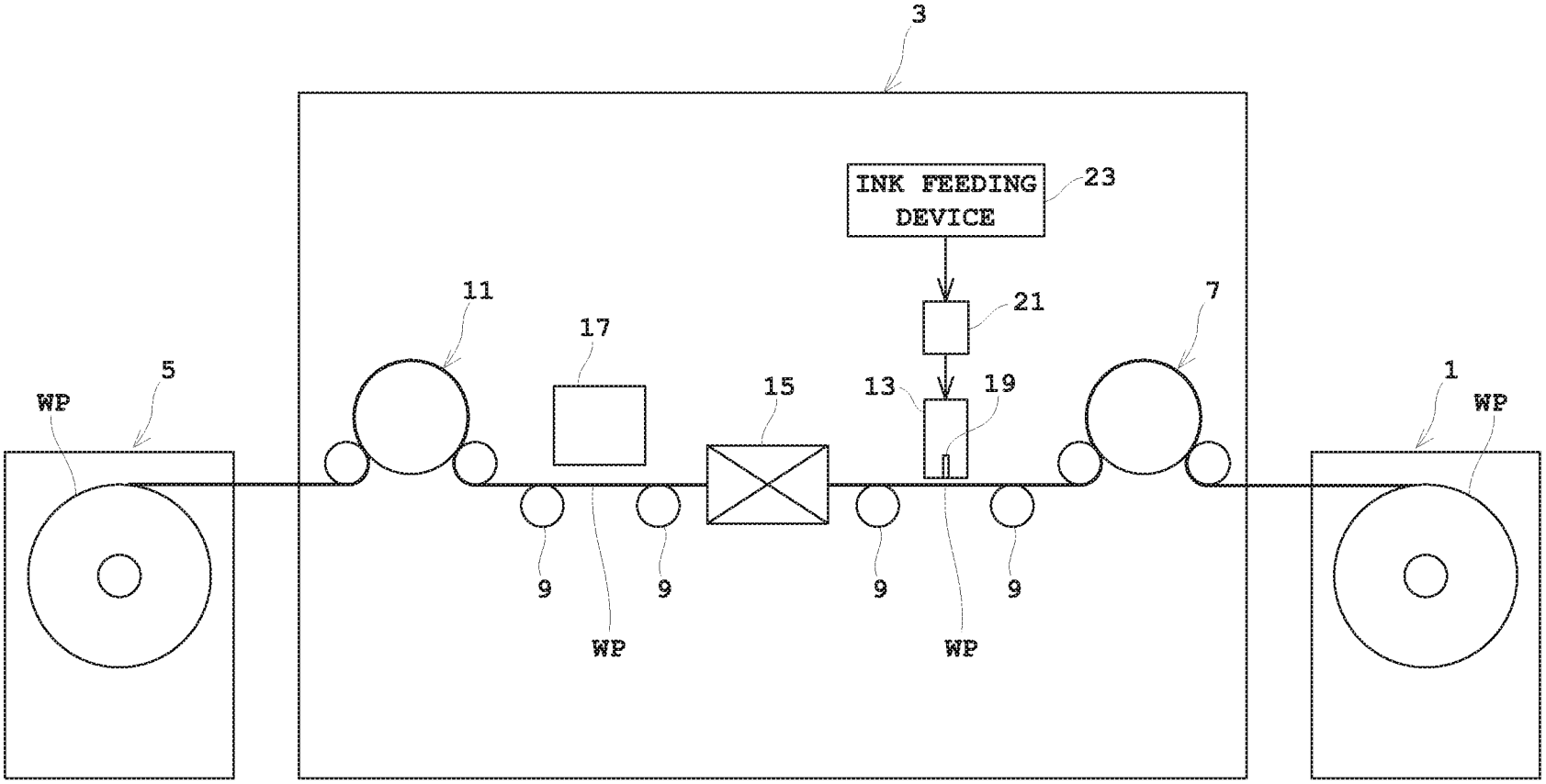
FIG. 1 is an outline schematic view showing an entire construction of an inkjet printing system according to an embodiment.

FIG. 1 is an outline schematic view showing an entire construction of an inkjet printing system according to the embodiment.

The inkjet printing system according to this embodiment includes a paper feeder 1, an inkjet printing apparatus 3, and a takeup roller 5. The paper feeder 1 holds a roll of web paper WP to be rotatable about a horizontal axis, and unwinds the web paper WP to feed it to the inkjet printing apparatus 3. The inkjet printing apparatus 3 carries out printing by dispensing ink droplets to the web paper WP to form images thereon, and feeds the web paper WP to the takeup roller 5. The takeup roller 5 winds up the web paper WP printed in the inkjet printing apparatus 3 into a roll form around a horizontal axis.

Regarding the supply side of web paper WP as upstream and the discharge side of web paper WP as downstream, the paper feeder 1 is located upstream of the inkjet printing apparatus 3, and the takeup roller 5 downstream of the inkjet printing apparatus 3.

The inkjet printing apparatus 3 has a drive roller 7 located in an upstream position for taking in the web paper WP from the paper feeder 1. The web paper WP unwound from the paper feeder 1 by the drive roller 7 is transported along a plurality of transport rollers 9 downstream toward the takeup roller 5. A drive roller 11 is located between the most downstream transport roller 9 and the takeup roller 5. This drive roller 11 feeds the web paper WP transported on the transport rollers 9 toward the takeup roller 5.

The inkjet printing apparatus 3 has, between the drive roller 7 and drive roller 11, a printing unit 13, a drying unit 15, and an inspection unit 17 arranged in the stated order from upstream. The drying unit 15 dries the web paper WP printed by the printing unit 13. The inspection unit 17 inspects whether there are scumming, omissions and so on in printed portions.

The printing unit 13 has inkjet heads 19 for dispensing ink in the form of ink droplets to the web paper WP. It is common practice to provide a plurality of inkjet heads 19 arranged along a transport direction of the web paper WP. For example, four printing units 13 in total are provided for black (K), cyan (C), magenta (M), and yellow (Y). However, the following description will be made assuming that only one printing head 13 is provided, in order to facilitate understanding of the invention. The printing unit 13 includes a plurality of inkjet heads 19 also in a horizontal direction (transverse direction) perpendicular to the transport direction of the web paper WP. The printing unit 13 has a plurality of inkjet heads 19 just to be capable of printing without moving over a printing area transversely of the web paper WP. The above inkjet heads 19 receive a supply of ink through a subtank 21 from an ink feeding device 23.

The above web paper WP corresponds to the "printing medium" in this invention.

Figure 2:
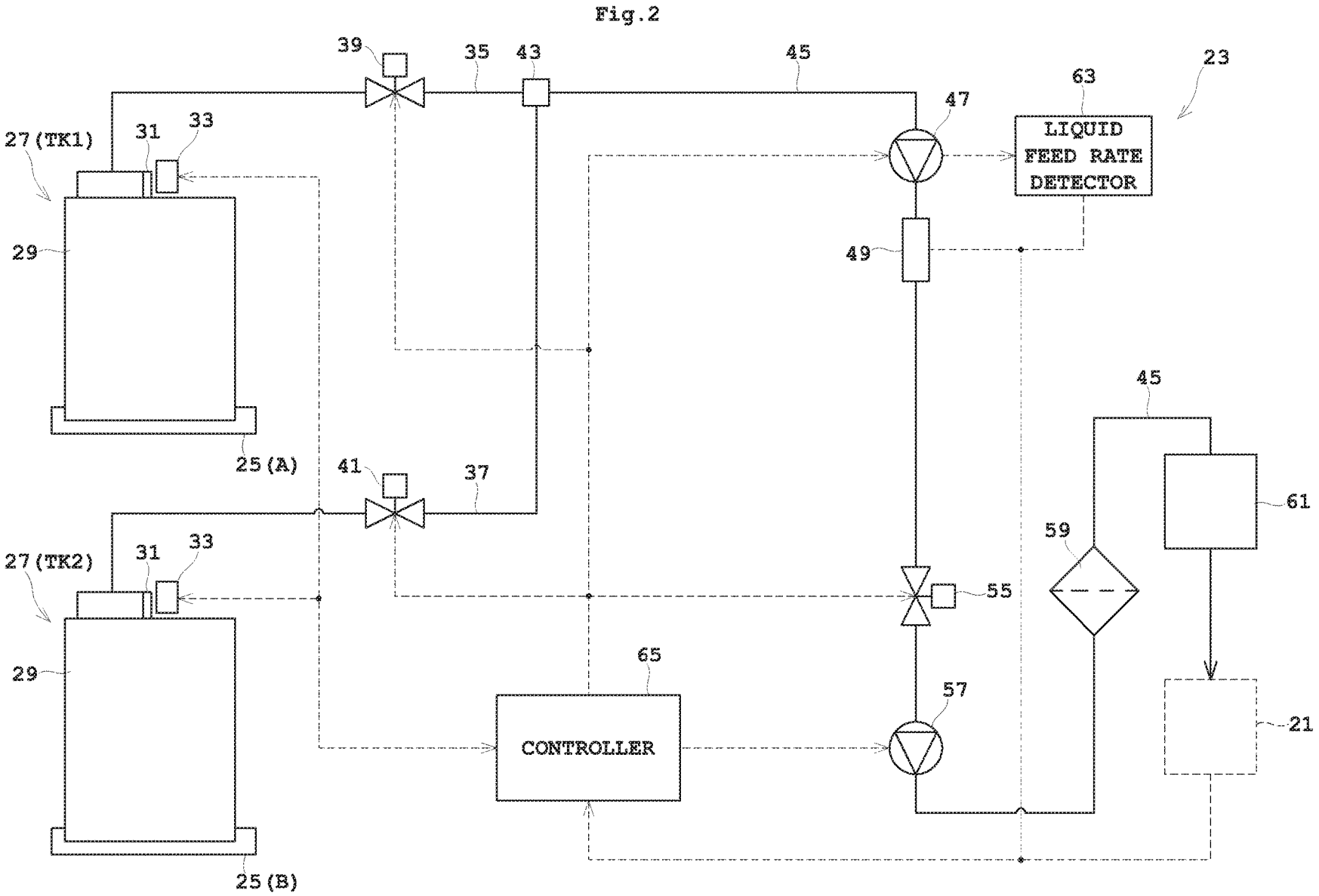
FIG. 2 is a view showing an entire construction of an ink feeding device.

The ink feeding device 23 will now be described with reference to FIG. 2. FIG. 2 is a view showing an entire construction of the ink feeding device 23.

The ink feeding device 23 includes a plurality of holders 25. This embodiment will be described taking for example a construction having two holders 25. When distinguishing these holders 25, they will be called holder A and holder B in the following description. The two holders A and B removably hold ink tanks 27, respectively. The two ink tanks 27 store interchangeable inks. The interchangeable inks here are, for example, the same products in the same color by the same manufacturer or by compatible manufacturers. The interchangeable inks therefore do not include functional inks which exhibit predetermined functions (such as coating on the web paper WP) only by mixing two types of liquid, for example.

The two ink tanks 27 will be called herein ink tanks TK1 and TK2. Replacement tanks 27 used for emptied tanks will be called TK3 and so on. When the ink tanks 27 need to be distinguished, they will be called ink tanks TK1, TK2, and so on. Each ink tank 27 has a reservoir portion 29 and a tag 31. The reservoir portion 29 stores the ink. The tag 31 contains an IC memory and is attached to the reservoir portion 29. The tag 31 has recorded thereon identification information identifying the individual of the ink tank 27, the volume of the ink stored in the reservoir portion 29, and so on. Each holder 25 has a reader 33 for reading the information on this tag 31. The reader 33 contacts the tag 31 and reads the information from the tag 31.

Each ink tank 27 held by each holder 25 has one end of one of branch pipes 35 and 37 connected thereto. One branch pipe 35 has a switch valve 39, while the other branch pipe 37 has a switch valve 41. The switch valves 39 and 41 permit or block flow of the inks through the branch pipes 35 and 37. Only one of the switch valves 39 and 41 is selectively opened, without being opened at the same time. The two branch pipes 35 and 37 are connected at the other ends to a collective joint 43. The collective joint 43 has one end of a feed pipe 45 connected thereto, the other end of the feed pipe 45 being connected to the subtank 21. The feed pipe 45 is a pipe for feeding the ink stored in each ink tank 27 to the subtank 21. The feed pipe 45 is connected to the inkjet heads 19 through the subtank 21.

The feed pipe 45 has a first pump 47, an intermediate tank 49, a switch valve 55, a second pump 57, a filter 59, and a degassing module 61 arranged in the stated order from the collective joint 43 toward the subtank 21.

The first pump 47 forms a liquid flow of ink from the branch pipe 35 or 37 to the intermediate tank 49. When the first pump 47 is operated in a state of one or both of the switch valves 39 and 41 being open, the ink will be fed from one or both of the two ink tanks 27 to the intermediate tank 49. The first pump 47 has a liquid feed rate detector 63 connected thereto. The liquid feed rate detector 63 detects a feed rate of ink to the feed pipe 45 and intermediate tank 49 by detecting the number of times of operation or an operating time of the first pump 47. Based on a liquid feed rate per unit time in the specifications of the first pump 47 and the operating time of the first pump 47, for example, the liquid feed rate detector 63 can calculate an amount of ink fed from liquid feed rate per unit time×operating time. The intermediate tank 49 has a space above liquid level therein in communication with ambient air, to remove large bubbles having formed within the ink before feeding it to the degassing module 61.

The subtank 21 has a level sensor (not shown). When an amount of ink in the subtank 21 becomes less than a certain amount with ink consumption by the inkjet heads 19, the controller 65 will detect this, open the switch valve 55, and operate the second pump 57, to bring the amount of ink in the subtank 21 up to the certain amount. At this time, the amount of ink stored in the intermediate tank 49 decreases. The intermediate tank 49 also has a level sensor (not shown). When an amount of ink in the intermediate tank 49 becomes less than a certain amount, the controller 65 will detect this, open one of the switch valves 39 and 41, and operate the first pump 47, to bring the amount of ink in the intermediate tank 49 up to the certain amount. From the output of the liquid feed rate detector 63 and information on which of the switch valves 39 and 41 has been opened, the controller 65 can acquire knowledge how much ink has been fed from each of the holder A and holder B. The intermediate tank 49 acts also as a buffer tank for temporarily storing the ink to prevent an ink exhaustion occurring downstream thereof.

The first pump 47 corresponds to the "pump" in this invention. The intermediate tank 49 corresponds to the "mixer" in this invention.

The ink stored in the intermediate tank 49 is fed by operating the second pump 57 with the switch valve 55 opened. The ink fed from the intermediate tank 49 by the second pump 57 is sent through the filter 59 and degassing module 61 to the subtank 21. The filter 59 removes foreign substances from the ink. The degassing module 61 removes bubbles from the ink. When a lower limit sensor (not shown) of the intermediate tank 49 operates, the switch valve 55 is closed and the second pump 57 is stopped.

The drive rollers 7 and 11, printing unit 13, drying unit 15, inspection unit 17, and ink feeding device 23 noted hereinbefore are controlled overall by the controller 65. The controller 65 includes a CPU and memory not shown. In this embodiment, the controller 65 controls the feed rate of the ink from each of the holder A and holder B by opening one of the switch valves 39 and 41. That is, the feed rate of the ink from the ink tank 29 held by the holder A and that of the ink from the ink tank 29 held by the holder B are derived from the numbers of times the switch valves 39 and 41 are opened and the ink feed rates detected by the liquid feed rate detector 63. While, in this embodiment, the inks are fed from both the ink tanks TK1 and TK2 until one of the inks in any one of the ink tanks TK1 and TK2 held by the holders A and B becomes exhausted, both the switch valves 39 and 41 are never opened at the same time, and when seen instantaneously, only one of the switch valves 39 and 41 is opened.

Thus, since the ink feed rates from the two holders A and B are controlled in this embodiment by opening and closing the switch valves 39 and 41, the control can be carried out more easily than where adjustment is carried out of opening degrees of flow regulating valves or of liquid feed rates of pumps.

The above holder A corresponds to the "first holder" and the holder B to the "second holder" in this invention.

Figure 3:
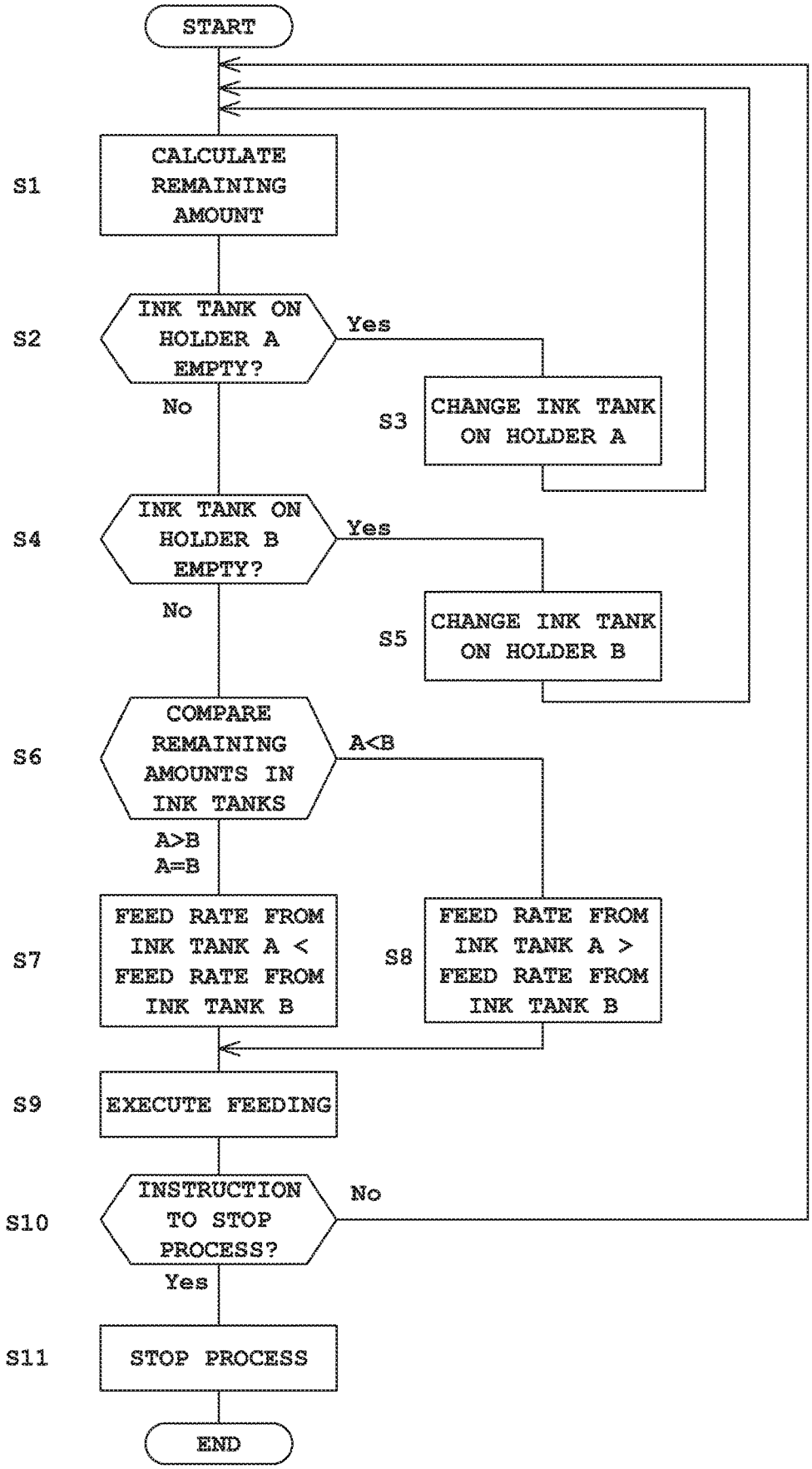
FIG. 3 is a flow chart showing ink feed control.
Figure 4:
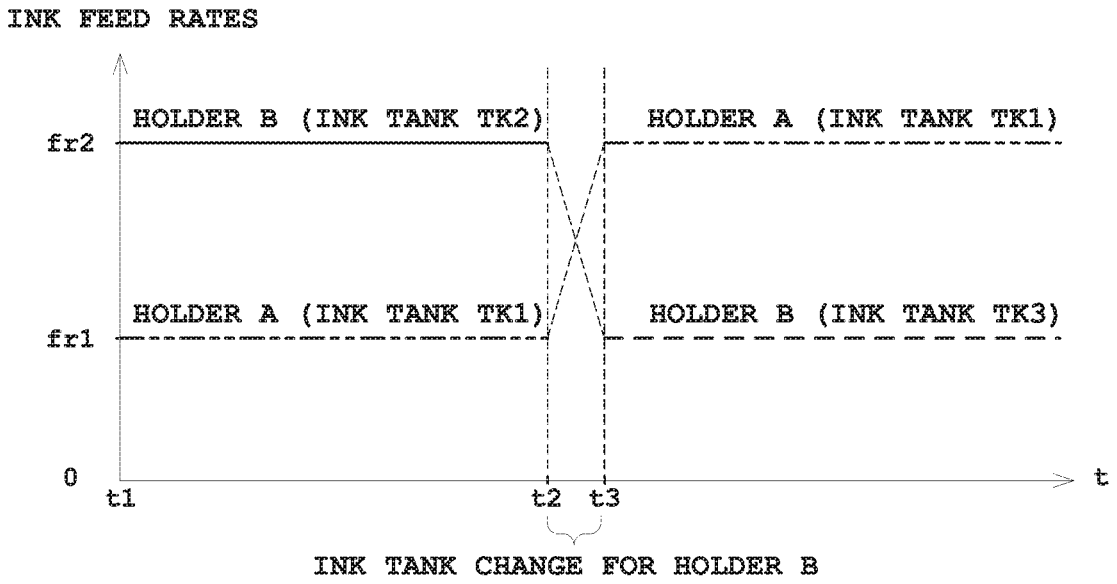
FIG. 4 is a time chart of ink feed control according to the embodiment.

Next, the ink feed control in the above ink feeding device will be described with reference to FIGS. 3 and 4. FIG. 3 is a flow chart showing the ink feed control. FIG. 4 is a time chart of the ink feed control according to the embodiment.

It is assumed here that the ink tank TK1 is held by the holder A of the holders 25 and that the ink tank TK2 is held by the holder B.

Step S1

The controller 65 calculates remaining ink amounts in the ink tank TK1 on the holder A and the ink tank TK2 on the holder B.

Specifically, the controller 65 determines an amount of ink fed from each of the ink tanks 27 on the holders A and B from the number of times of opening and closing of the switch valves 39 and 41 and the liquid feed rate detected by the liquid feed rate detector 63. The controller 65 can also calculate a remaining ink amount in each of the ink tanks TK1 and TK2 on the holders A and B from a difference between a total volume of ink recorded on the tag 31 of each ink tank 27 and the amount of ink determined. The calculated remaining ink amount is recorded on the tag 31 for use as a total volume of ink at the time of calculating a next remaining ink amount.

Steps S2 and S3

Upon determination made from the calculated remaining amount that the ink tank TK1 on the holder A is empty, the controller 65 indicates by an indicator (not shown) a need to change the ink tank TK1 on the holder A. Consequently, the operator will replace the ink tank TK1 on the holder A with a new tank.

Steps S4 and S5

Upon determination made from the calculated remaining amount that the ink tank TK2 on the holder B is empty, the controller 65 indicates by the indicator (not shown) a need to change the ink tank TK2 on the holder B. Consequently, the operator will replace the ink tank TK2 on the holder B with a new tank.

Step S6

The controller 65 compares the remaining ink amounts in the ink tank TK1 on the holder A and in the ink tank TK2 on the holder B. According to a result of the comparison, the process is branched to step S7 or step S8. When the remaining amounts are equal, the process may be set to proceed to either one of steps S7 and S8, but in this embodiment it is set to proceed to step S6.

Step S7

When the result of the comparison in step S6 of the remaining ink amounts shows that the remaining amount in the ink tank TK1 on the holder A is larger than that in the ink tank TK2 on the holder B, the controller 65 makes the feed rate from the ink tank TK1 on the holder A less than the feed rate from the ink tank TK2 on the holder B. Specifically, supposing that the number of times of opening and closing per unit time of the switch valve 39 which controls flow of the ink from the ink tank TK1 on the holder A is set to N, for example, then the number of times of opening and closing per same unit time of the switch valve 41 which controls flow of the ink from the ink tank TK2 on the holder B is set to 2N. As for the feed rates, the feed rate of the ink from the ink tank TK1 on the holder A is set to a first feed rate fr1, and the feed rate of the ink from the ink tank TK2 on the holder B is set to a second feed rate fr2, which are put in expression: first feed rate fr1<second feed rate fr2.

Step S8

On the other hand, when the result of the comparison in step S6 of the remaining ink amounts shows that the remaining amount in the ink tank TK1 on the holder A is smaller than that in the ink tank TK2 on the holder B, the controller 65 makes the feed rate from the ink tank TK1 on the holder A more than the feed rate from the ink tank TK2 on the holder B.

Step S9

The controller 65 supplies the ink at the feed rate set in step S7 or step S8. Specifically, the controller 65 selectively opens the switch valves 39 and 41 by time sharing, without opening the switch valves 39 and 41 at the same time. At this time, as noted above, a difference is made between the feed rate from the ink tank TK1 on the holder A and the feed rate from the ink tank TK2 on the holder B. After the ink is fed at the first feed rate fr1 from the ink tank TK1 on the holder A, the ink is fed at the second feed rate fr2 from the ink tank TK2 on the holder B, and this is repeated alternately. Consequently, the ink from the ink tank TK1 and the ink from the ink tank TK2 are mixed in the intermediate tank 49.

That is, the controller 65 selectively feeds the inks from both the ink tanks TK1 and TK2 on the holder A and holder B, and with an increase in the feed rate from the ink tank 27 having the less ink remaining amount.

Steps S10 and S11

The controller 65 branches off the process based on whether or not the operator has inputted from an operating unit, not shown, an instruction to stop the process. When no process stopping instruction is inputted, the process proceeds to step S1 for calculating ink remaining amounts in the ink tanks TK1 and TK2 again. On the other hand, when process stopping is instructed, the controller 65, after calculating ink remaining amounts, execute step S11 to stop the process. The remaining ink amounts calculated in step S11 are also recorded on the tags 31.

The ink feed rates in the foregoing sequence of process may be depicted in a time chart as shown in FIG. 4.

Here, the ink tank TK1 is held by the holder A, and the ink tank TK2 by the holder B. In an initial state, the ink tanks TK1 and TK2 are not empty, but have equal remaining ink amounts. As a result of a remaining amount comparison, the feed rate of the ink from the ink tank TK1 held by the holder A is set to the first feed rate fr1 which is less than the second feed rate fr2. The switch valves 39 and 41 are operated to feed the ink from the ink tank TK1 and the ink from the ink tank TK2 to the intermediate tank 49, so that the feed rate of the ink from the ink tank TK2 held by the holder B be the second feed rate fr2 which is higher than the first feed rate fr1.

Next, assume that a point of time t2 is reached while these ink feed rates are maintained. Assume that the ink tank TK2 held by the holder B with the higher ink feed rate becomes empty at this point of time t2. At this point of time t2, the ink tank TK2 is removed from the holder B, and a new ink tank TK3 is placed on the holder B. The result of a remaining ink amount comparison shows a larger remaining ink amount in the ink tank TK3 newly held by the holder B. So, the feed rate of the ink from the ink tank TK1 held by the holder A is set to the second feed rate fr2, and the feed rate of the ink from the ink tank TK3 held by the holder B is set to the first feed rate fr1 which is less than the second feed rate fr2. Then, the ink feeding to the intermediate tank 49 is resumed at a point of time t3.

Between point of time t2 and point of time t3, printing is continued with the inks stored in the subtank 21 and in the intermediate tank 49, and thus the printing is not interrupted.

According to this embodiment, the controller 65 feeds ink from each ink tank 27 to the intermediate tank 49, and makes different a feed rate of the ink from each of the ink tanks 27 held by the two holders. Consequently, since the inks are mixed in the intermediate tank 49, even if the inks are manufactured in different lots, differences in the physical properties between the lots are reduced. As a result, even if the manufacturing lot of the ink in the ink tank 27 changes when the ink tank 27 is changed, an ink density difference in prints is inconspicuous, which can inhibit deterioration of print quality. Moreover, since all the ink tanks 27 do not become empty at the same time, no lowering occurs in the operating rate of the inkjet printing apparatus 3.

Since the controller 65 only maintains the different feed rates of first feed rate fr1 and second feed rate fr2 until one of the ink tanks 27 becomes empty, the feed rate control of ink can be performed easily.

Further, the controller 65 compares the ink remaining amounts, and uses with priority the ink tank 27 having the less ink remaining amount. This can prevent overlapping of timing of the two ink tanks 27 held by the holder A and holder B becoming empty.

This invention is not limited to the foregoing embodiment, but may be modified as follows:

(1) In the foregoing embodiment, the ratio between the ink feed rates set in steps S7 and S8 is maintained until one of the ink tanks 27 becomes empty. However, this invention is not limited to such a mode.

Figure 5:
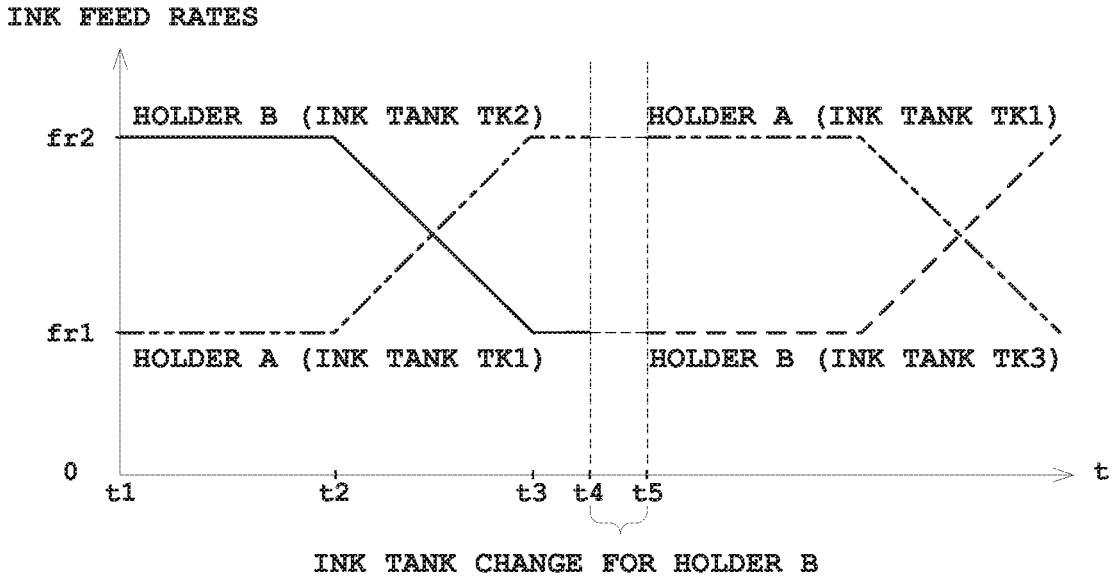
FIG. 5 is a time chart of ink feed control according to a modification.

That is, as shown in FIG. 5, the ratio between the ink feed rates may be varied instead of being maintained. In this modification, from point of time t1 to point of time t2, the inks are fed at the first feed rate fr1 from the ink tank TK1 held by the holder A and at the second feed rate fr2 from the ink tank TK2 held by the holder B. Subsequently, at point of time t2 after elapse of a predetermined time from point of time t1, the feed rate from the ink tank TK1 held by the holder A begins to be brought from the first feed rate fr1 close to the second feed rate fr2, gradually toward point of time t3. On the other hand, the feed rate from the ink tank TK2 held by the holder B is brought from the second feed rate fr2 close to the first feed rate fr1, gradually toward point of time t3.

Such ink feed rate control produces the same effect as in the foregoing embodiment. Since the ink mixing ratio in the intermediate tank 49 varies gradually, there occurs no shift of balance toward only one of the ink from the ink tank 27 held by the holder A and the ink from the ink tank 27 held by the holder B. Consequently, even when manufacturing lots are different between the inks in the ink tanks 27 held by the holder A and holder B, the differences in physical properties between the lots can be further reduced.

(2) The plurality of holders are two in the foregoing embodiment, but this invention is not limited to this number. It is possible to provide three or more holders, for example. In this case also, the inks are fed from all the ink tanks held by the three holders, and all the ink feed rates are made different. Consequently, the differences in physical properties between the lots can be further reduced.

(3) In the foregoing embodiment, the inks are fed from all the ink tanks 27 through the branch pipes 35 and 37 merged into the feed pipe 45 by operating the first pump 47 mounted on the feed pipe 45, and the feed rate of ink from each ink tank 27 is varied by the numbers of times of opening and closing or amounts of time of opening and closing of the switch valves 39 and 41. However, this invention is not limited to such a mode. In place of the liquid feeding by the first pump 47 on the feed pipe 45, a pump may be provided for each of the branch pipes 35 and 37 and the feed rate of the ink from each ink tank 27 may be varied by adjusting the liquid feed rate by this pump. Alternatively, the liquid feeding by the first pump 47 on the feed pipe 45 may be maintained as it is, with the controller 65 controlling the opening degree of a flow regulating valve provided on each of the branch pipes 35 and 37 to shift the balance between the ink feed rates.

(4) In the foregoing embodiment, the intermediate tank 49 has been described as corresponding to the "mixer" in this invention. However, the "mixer" in this invention may just mix the ink from the ink tank TK held by the holder A and the ink from the ink tank TK held by the holder B. It is also possible to understand as the "mixer" any one or all of the collective joint 43, intermediate tank 49, filter 59, and degassing module 61.

(5) In the foregoing embodiment, the web paper WP is used as printing medium, but this invention is not limited to such printing medium. Other printing media include film and cut sheet paper, for example.

This invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus for forming images with ink droplets, comprising:

an inkjet head for dispensing ink fed thereto to form images on a printing medium;

a plurality of holders for removably holding a plurality of ink tanks storing inks interchangeable with each other;

branch pipes each having one end thereof connected to the ink tank held by one of the holders;

a mixer provided at the other ends of the branch pipes;

a pump for feeding the ink from each holder to the mixer;

a feed pipe connecting the mixer and the inkjet head; and a controller for controlling ink feeding to the mixer, wherein the controller feeds the inks from all the ink tanks held by the holders to the mixer, wherein the holders include two holders which are a first holder and a second holder; and wherein the controller feeds the ink from the ink tank held by the first holder to the mixer at a first feed rate, and feeds the ink from the ink tank held by the second holder to the mixer at a second feed rate different from the first feed rate.

2. The inkjet printing apparatus according to claim 1, wherein the controller maintains the first feed rate and the second feed rate until one of the ink tanks held by the first holder and the second holder becomes empty.

3. The inkjet printing apparatus according to claim 2, wherein the controller compares remaining amounts in the ink tanks held by the first holder and the second holder, sets the first feed rate>the second feed rate when the remaining amount in the ink tank held by the first holder is smaller, and sets the first feed rate<the second feed rate when the remaining amount in the ink tank held by the second holder is smaller.

4. The inkjet printing apparatus according to claim 2, wherein:

each branch pipe has a switch valve mounted thereon for permitting or blocking flow of the ink;

the pump is mounted on the feed pipe; and the controller controls opening and closing of each switch valve to vary the feed rate.

5. The inkjet printing apparatus according to claim 3, wherein:

each branch pipe has a switch valve mounted thereon for permitting or blocking flow of the ink;

the pump is mounted on the feed pipe; and the controller controls opening and closing of each switch valve to vary the feed rate.

6. The inkjet printing apparatus according to claim 1, wherein the controller compares remaining amounts in the ink tanks held by the first holder and the second holder, sets the first feed rate>the second feed rate when the remaining amount in the ink tank held by the first holder is smaller, and sets the first feed rate<the second feed rate when the remaining amount in the ink tank held by the second holder is smaller.

7. The inkjet printing apparatus according to claim 6, wherein:

each branch pipe has a switch valve mounted thereon for permitting or blocking flow of the ink;

the pump is mounted on the feed pipe; and the controller controls opening and closing of each switch valve to vary the feed rate.

8. The inkjet printing apparatus according to claim 1, wherein:

each branch pipe has a switch valve mounted thereon for permitting or blocking flow of the ink;

the pump is mounted on the feed pipe; and the controller controls opening and closing of each switch valve to vary the feed rate.

9. The inkjet printing apparatus according to claim 1, wherein:

each branch pipe has a switch valve mounted thereon for permitting or blocking flow of the ink;

the pump is mounted on the feed pipe; and the controller controls opening and closing of each switch valve to vary the feed rate.

10. The inkjet printing apparatus according to claim 1, wherein:

each branch pipe has a switch valve mounted thereon for permitting or blocking flow of the ink;

the pump is mounted on the feed pipe; and the controller controls opening and closing of each switch valve to vary the feed rate.

11. An ink feeding method for an inkjet printing apparatus which forms images with ink droplets, the apparatus having:

an inkjet head for dispensing ink fed thereto to form the images on a printing medium;

a plurality of holders for removably holding a plurality of ink tanks storing inks interchangeable with each other;

branch pipes each having one end thereof connected to the ink tank held by one of the holders;

a mixer provided at the other ends of the branch pipes; and a pump for feeding the ink from each holder to the mixer, the method comprising a feeding step for feeding the inks from all the ink tanks held by the holders to the mixer, wherein the holders include two holders which are a first holder and a second holder; and wherein the feeding step feeds the ink from the ink tank held by the first holder to the mixer at a first feed rate, and feeds the ink from the ink tank held by the second holder to the mixer at a second feed rate different from the first feed rate.

12. The ink feeding method for the inkjet printing apparatus according to claim 11, wherein the feeding step maintains the first feed rate and the second feed rate until one of the ink tanks held by the first holder and the second holder becomes empty.

13. The ink feeding method for the inkjet printing apparatus according to claim 12, further comprising:

a step of calculating ink remaining amounts in the ink tanks; and a step of comparing the ink remaining amounts in the ink tanks held by the holders;

the calculating and comparing steps being executed before the feeding step;

wherein:

the comparing step compares remaining amounts in the ink tanks held by the first holder and the second holder; and the feeding step sets the first feed rate>the second feed rate when the remaining amount in the ink tank held by the first holder is smaller, and sets the first feed rate<the second feed rate when the remaining amount in the ink tank held by the second holder is smaller.

14. The ink feeding method for the inkjet printing apparatus according to claim 11, further comprising:

a step of calculating ink remaining amounts in the ink tanks; and a step of comparing the ink remaining amounts in the ink tanks held by the holders;

the calculating and comparing steps being executed before the feeding step;

wherein:

the comparing step compares remaining amounts in the ink tanks held by the first holder and the second holder; and the feeding step sets the first feed rate>the second feed rate when the remaining amount in the ink tank held by the first holder is smaller, and sets the first feed rate<the second feed rate when the remaining amount in the ink tank held by the second holder is smaller.

15. The ink feeding method for the inkjet printing apparatus according to claim 11, further comprising:

a step of calculating ink remaining amounts in the ink tanks; and a step of comparing the ink remaining amounts in the ink tanks held by the holders;

the calculating and comparing steps being executed before the feeding step;

wherein, after the step of calculating the ink remaining amounts and before the comparing step, when the remaining amounts show that one of the holders is holding an empty ink tank, a step is executed for changing the empty ink tank.

16. The ink feeding method for the inkjet printing apparatus according to claim 11, further comprising:

a step of calculating ink remaining amounts in the ink tanks; and a step of comparing the ink remaining amounts in the ink tanks held by the holders;

the calculating and comparing steps being executed before the feeding step;

wherein, after the step of calculating the ink remaining amounts and before the comparing step, when the remaining amounts show that one of the holders is holding an empty ink tank, a step is executed for changing the empty ink tank.

17. An inkjet printing apparatus for forming images with ink droplets, comprising:

an inkjet head for dispensing ink fed thereto to form images on a printing medium;

a plurality of holders for removably holding a plurality of ink tanks storing inks interchangeable with each other;

branch pipes each having one end thereof connected to the ink tank held by one of the holders;

a mixer provided at the other ends of the branch pipes;

a pump for feeding the ink from each holder to the mixer;

a feed pipe connecting the mixer and the inkjet head; and a controller for controlling ink feeding to the mixer, wherein the controller feeds the inks from all the ink tanks held by the holders to the mixer, wherein the holders include two holders which are a first holder and a second holder; and wherein the controller feeds the ink from the ink tank held by the first holder to the mixer at a first feed rate, feeds the ink from the ink tank held by the second holder to the mixer at a second feed rate different from the first feed rate, brings the first feed rate gradually close to the second feed rate, and brings the second feed rate gradually close to the first feed rate.

18. An ink feeding method for an inkjet printing apparatus which forms images with ink droplets, the apparatus having:

an inkjet head for dispensing ink fed thereto to form the images on a printing medium;

a plurality of holders for removably holding a plurality of ink tanks storing inks interchangeable with each other;

branch pipes each having one end thereof connected to the ink tank held by one of the holders;

a mixer provided at the other ends of the branch pipes; and a pump for feeding the ink from each holder to the mixer, the method comprising a feeding step for feeding the inks from all the ink tanks held by the holders to the mixer, wherein the holders include two holders which are a first holder and a second holder; and wherein the feeding step feeds the ink from the ink tank held by the first holder at a first feed rate, feeds the ink from the ink tank held by the second holder at a second feed rate different from the first feed rate, brings the first feed rate gradually close to the second feed rate, and brings the second feed rate gradually close to the first feed rate.

* * * * *